US007121788B2

(12) United States Patent
Daudel et al.

(10) Patent No.: US 7,121,788 B2
(45) Date of Patent: Oct. 17, 2006

(54) EXHAUST GAS TURBOCHARGER FOR AN INTERNAL COMBUSTION ENGINE

(75) Inventors: Helmut Daudel, Schomdorf (DE); Helmut Finger, Leinfelden-Echterdingen (DE); Peter Fledersbacher, Stuttgart (DE); Hans-Josef Hemer, Worms (DE); Ralf Koch, Rüssingen (DE); Stephan Schenkel, Stuttgart (DE); Siegfried Sumser, Stuttgart (DE)

(73) Assignee: BorgWarner Inc., Auburn Hills, MI (US)

( * ) Notice: Subject to any disclaimer, the term of this patent is extended or adjusted under 35 U.S.C. 154(b) by 58 days.

(21) Appl. No.: 10/524,882

(22) PCT Filed: Aug. 9, 2003

(86) PCT No.: PCT/EP03/08868

§ 371 (c)(1),
(2), (4) Date: Feb. 16, 2005

(87) PCT Pub. No.: WO2004/022925

PCT Pub. Date: Mar. 18, 2004

(65) Prior Publication Data

US 2005/0268610 A1 Dec. 8, 2005

(30) Foreign Application Priority Data

Aug. 16, 2002 (DE) ..... 102 37 413

(51) Int. Cl.
*F01D 1/24* (2006.01)
*F01D 1/02* (2006.01)
*F01D 17/12* (2006.01)

(52) U.S. Cl. ..... 415/159; 415/164; 415/185; 415/204

(58) Field of Classification Search ..... 415/163, 415/164, 165, 185, 191, 204, 205, 159, 160
See application file for complete search history.

(56) References Cited

U.S. PATENT DOCUMENTS 4,776,168 A * 10/1988 Woollenweber ..... 60/602
5,454,225 A * 10/1995 Sumser et al. ..... 415/166
5,758,500 A * 6/1998 Sumser et al. ..... 415/158
6,220,031 B1 * 4/2001 Daudel et al. ..... 415/159
6,739,134 B1 * 5/2004 Fledersbacher et al. ..... 415/158
7,021,057 B1 * 4/2006 Sumser et al. ..... 415/164

* cited by examiner

*Primary Examiner*—Igor Kershteyn
(74) *Attorney, Agent, or Firm*—Akerman Senterfitt; Stephan Pendorf; Greg Oziegielewski

(57) ABSTRACT

An exhaust gas turbocharger for an internal combustion engine comprises a turbine in the exhaust line and a compressor, which is driven by the turbine and which is located inside the intake tract of the internal combustion engine. The turbine comprises a flow duct having a radial flow entrance cross-section, and a flow ring is provided that delimits the flow entrance cross-section. An adjustable vane is placed in the radial flow entrance cross-section for variably adjusting this flow entrance cross-section. The flow ring inside the housing of the exhaust gas turbine can be axially displaced between a contact position toward the vane and a position that frees a gap toward the vane.

7 Claims, 2 Drawing Sheets

EXHAUST GAS TURBOCHARGER FOR AN INTERNAL COMBUSTION ENGINE

CROSS REFERENCE TO RELATED APPLICATION

This application is a national stage of PCT/EP2003/008868 filed Aug. 9, 2003 and based upon DE 102 37 413.9 filed Aug. 16, 2002 under the International Convention.

BACKGROUND OF THE INVENTION

1. Field of the Invention

The invention concerns an exhaust gas turbocharger for an internal combustion engine.

2. Related Art of the Invention

From the publication DE 196 15 237 C2 an exhaust gas turbocharger of this general type is known, having a turbine with a radial and a semi-axial flow intake cross-section in the exhaust flow area of the turbine. The flow intake profiles, between which a flow promoting contoured flow ring is provided in the flow intake area of the turbine, makes possible both a radial and also a semi-axial impinging onto the turbine wheel. In the radial flow entry cross-section a variable geometry arrangement is provided with adjustable guide vanes, via which the flow entry cross-section can be varied. By adjustment of the guide vanes the gas pressure, as well as the type and manner of the flow of the exhaust gas onto the turbine wheel, can be influenced, whereby the performance of the turbine and the output of the compressor can be adjusted depending upon the requirements and operating condition of the internal combustion engine.

This type of exhaust gas turbocharger, having variable turbine geometry, is employed also in braking operation of the internal combustion engine. In the braking operation the guide vanes are adjusted into a blocking or choking position, in which the intake cross-section is significantly reduced, whereupon an elevated exhaust pressure builds up in the conduit upstream of the turbine, which brings about, that the exhaust gas flows with increased velocity through the channels between the guide vanes, whereupon the turbine wheel is impinged with a stronger impulse. This brings about an elevated compressor output, so that the fresh or combustible air reaching the motor is also placed under an elevated charge pressure. The cylinder is acted on with increased charge pressure on the inlet side, at the same time the exhaust side is experiencing elevated exhaust gas pressure, which opposes the evacuation or exhausting of the compressed air via the brake value in the exhaust gas conduit. During motor operation the piston in the compression and exhaust stroke must perform compression work against the high overpressure in the exhaust side, whereby a strong brake effect is achieved.

The desired high brake power can however only be achieved when a desired pressure distribution exists within the turbine and when the exhaust gas flows through the turbine in the intended manner. It is a problem herein that leakages occur on the axial sides of the adjustable guide vanes, which can occur due to construction and manufacturing tolerances, however also due to wear and thermal expansion, and can strongly compromise the desired pressure relationship within the turbine, which negatively influences the motor brake power, and however also negatively influences the motor power in the combustion drive mode. This type of guide vane leakage results also from gaps inherently required in construction to enable movement of the guide vanes of the guide vane ring of the variable turbine geometry in the flow entry cross-section.

Similarly, from the publication DE 39 41 399 C1 an exhaust gas turbocharger for an internal combustion engine is known, which is equipped with a twin flow spiral channel with radial and semi-axial flow entry cross-section in the turbine housing, wherein the two flow channels are separated by a fixed separating wall. Between the radial and the semi-axial flow entry cross-section of the two flow channels there is, in the area of the end surface of the separating wall separating the two flow channels, an axially adjustable slider, which is adjustable between a position blocking the radial inflow cross-section and a position blocking the semi-axial inflow cross-section. The slider assumes the function of a variable geometry turbine part, via which the flow behavior of the flow onto the turbine wheel is to be influenced. Even with this turbocharger design, flow leakage or by-pass cannot be prevented.

The publication DE 35 41 508 C1 discloses an exhaust gas turbocharger with radial flow entry cross-section towards the turbine wheel, wherein in the flow entry cross-section a guide ring with adjustable guide vanes is provided. Two holder- or mount-rings engaging the guide vanes on their end surfaces are connected to each other via multiple screws distributed about the circumference. The screws are within spacer sleeves, which ensure a minimal separation of the two mounting rings. An axial relative movement of the outer support rings relative to the inner support ring is not possible on the basis of the screw connection, and namely neither in the direction of a larger separation of the support rings nor in the direction of a coming together of the support rings. This has only the consequence, that the gap between the axial end surfaces of the vanes of the guide vane assembly and the two support rings are arranged with fixed, non-changeable dimensions. Therein a compromise is entered into between having a sufficiently large degree of movement for the blades and a sufficiently small gap for avoidance of by-pass flows. Thermal expansion in the construction components can lead within the turbocharger to an enlargement of the gaps and thereby bring about undesired increase in leakage with correspondingly smaller compressor output.

The publication DE 100 29 640 A1 discloses an exhaust gas turbocharger with semi-axial and with radial flow entry cross-section to the turbine wheel which are separated by an axially displaceable flow ring. In the radial flow entry cross-section a guide vane ring with adjustable guide vanes and in the semi-axial cross-section a grid with fixed geometry are provided. If the guide vane ring in the radial cross-section is moved into the choke or blocking position, then a larger proportion of the exhaust gas flows through the semi-axial cross-section. Aerodynamic effects can be caused by the displacement of the flow ring in the direction of the radial ring of guide vanes.

SUMMARY OF THE INVENTION

The present invention is concerned with the task of increasing the degree of effectiveness of exhaust gas turbochargers having a radial flow entry cross-section and a variable turbine geometry. In particular, during motor braking operation, and in certain cases however also during combustion drive operation, the turbine output should be improved.

According to the design of the new exhaust gas turbocharger, it is provided that the position of the flow ring in the housing of the turbocharger is variably adjustable. According to the state of the art this flow ring is always provided as a component fixed with the turbocharger housing, in contrast to which the flow ring is moveable. By making the flow ring moveable, the possibility is created to reduce or even completely eliminate the gap dimension which is inherently required in construction to provide freedom of movement to the parts, or is created by wear or thermal expansion or by other causes. Leakages or flow-by at the end surface of the adjustable guide vanes can be substantially or completely excluded, and a desired pressure relationship can be adjusted within the turbine, which imparts a desired gas flow to the turbine wheel. In order to be able to adjust the radial guide vanes, a minimal gap at the axial end surface of the radial guide vanes is necessary; for adjusting the radial guide vanes the adjustable flow ring can be axially displaced in a position further distant from the radial ring of guide vanes. Subsequently, for closing of air gaps, the flow ring is advanced until contact with the end surface of the radial guide vanes or, as the case may be, another component of the radial guide grid or to a spacer provided for this purpose.

The flow ring is designed to be axially displaceable, whereby in particular guide vane gaps at the radial guide grid can be reduced. Alternatively, or additionally, it can be useful to provide a radial adjustability of the flow ring, which can be accomplished for example by an eccentric displacement of the flow ring and/or by a radial widening or narrowing of the flow ring.

In the case of an axially displaceable flow ring the displacement movement is preferably limited by abutments or end stops, which limit in particular the opening of the guide vane gap of the radial guide grid to a predetermined dimension. This permitted axial movement, which is identical with the axial play of the flow ring, corresponds preferably to approximately 0.15 mm to 0.3 mm. This comparatively small dimension shall ensure that the maximal play of the flow ring is limited to a predetermined dimension or measure, which ensures a functionality of the exhaust gas turbocharger both in the motor brake operation as well as in the combustion propulsion mode.

The flow ring can, in certain cases, also be mounted floating without being acted upon by an actuator. In any case, with increasing closure of the radial guide grid the static pressure on the guide grid side of the flow ring is strongly reduced, in comparison to which on the opposite lying side, due to the relatively low flow velocities in this area, the pressure remains at a high level. From this pressure differential there results a force, which presses the axially moveable flow ring at its end against the radial guide grid, whereby the guide grid gaps are reduced.

Axial relief bores can be provided in the flow ring, which extend between the axial surfaces of the flow ring, whereby a pressure equalization is made possible and the pressure force acting on the flow ring when lying against the the radial guide grid can be trimmed.

In the case of a radial guide grid with adjustable guide vanes these are preferably mounted, via an axial shaft, preferably on the turbocharger housing, preferably however also in the displaceable flow ring. In the case that the guide vanes are mounted double-sided also in the flow ring, the flow ring preferably includes recesses for receiving the associated vane shafts, wherein the depth of the recesses is preferably adapted to the axial length of the vane shafts, in order to be able to receive the vane shafts also in the case of a complete closure of the guide vane gap.

It can, in certain cases, also be useful to provide, in certain operating conditions of the internal combustion engine in motor braking operation and/or in the combustion drive mode, a desired measure of gap, with which the flow and pressure relationship within the charger housing in the turbine can, in a predetermined manner, be specifically and purposefully influenced. Besides this, it can be useful to provide supplemental criteria for the adjustment of the flow ring, for example in the manner, that the flow entry cross-section for the radial inflow should not exceed a maximum.

BRIEF DESCRIPTION OF THE DRAWINGS

Further advantages and useful embodiments can be found in the further claims, the description of the figures and the drawings. There is shown:

In the embodiments shown in FIGS. 1 through 3 the same components are indicated with the same reference numbers.

BRIEF DESCRIPTION OF THE DRAWINGS

Figure 1:
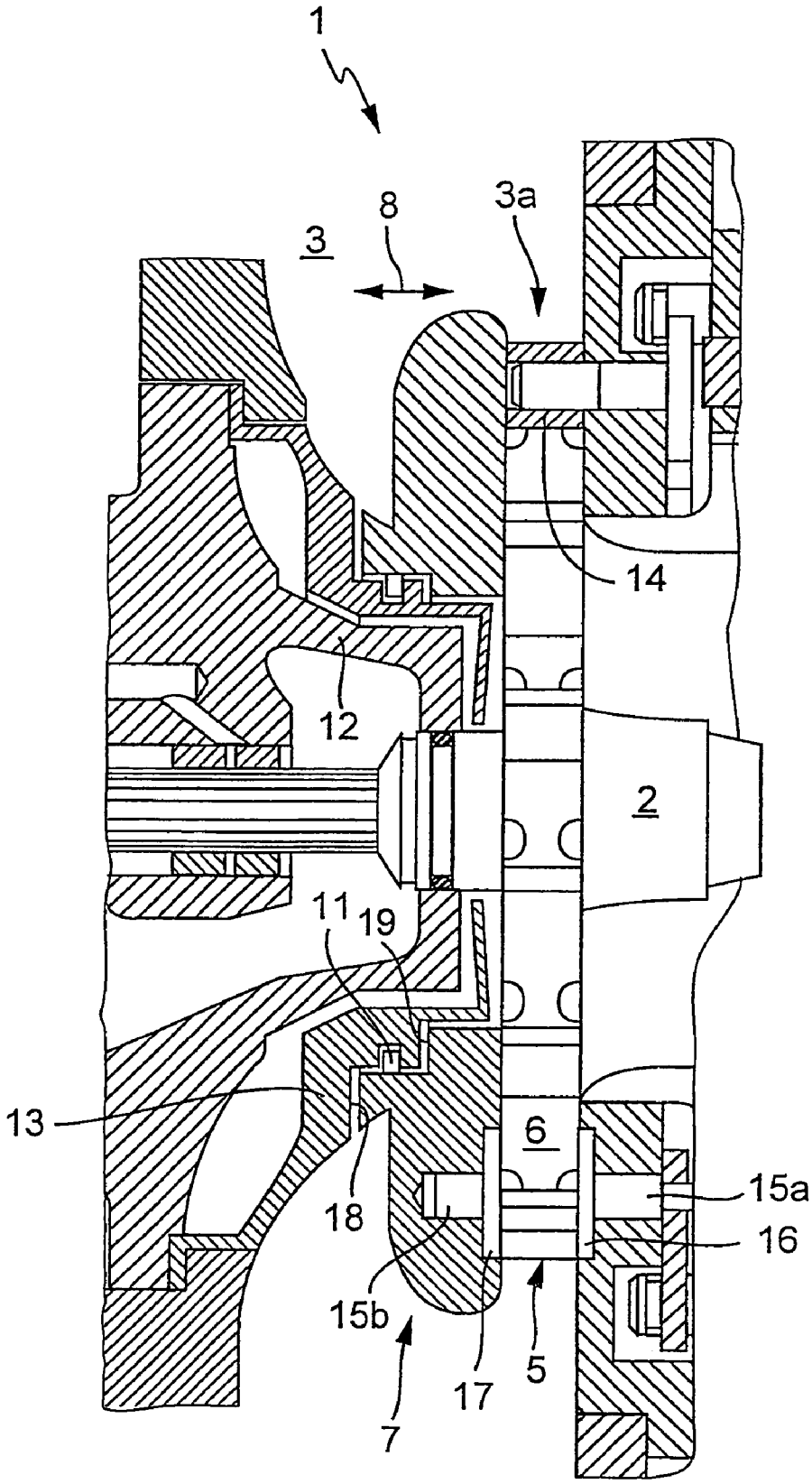
FIG. 1 a section through a turbine of an exhaust gas turbocharger with variable turbine geometry and axially adjustable flow ring, FIG. 2 a representation according to FIG. 1, however with modification in the area of the radial array of guide vanes, FIG. 3 a representation corresponding to FIG. 1 or, as the case may be, FIG. 2, however with a further modification in the area of the radial ring of guide vanes.

The turbine 1 of an exhaust gas turbocharger for an internal combustion engine shown in FIG. 1, for example for a diesel internal combustion engine or an otto-motor for a utility vehicle or a passenger vehicle, includes a turbine wheel 2 which is powered by exhaust gas under pressure from the internal combustion engine and which drives, via a connecting shaft, a not shown compressor of the exhaust gas turbocharger, which compressor draws in fresh air and compresses this to an elevated charge pressure, which is conveyed to the cylinder inlets of the internal combustion engine. The turbine 1 further includes a flow entry channel 3, which radially encompasses the turbine wheel 2 and includes a radial flow entry cross-section 3*a* going to the turbine wheel 2. In the radial flow entry cross-section 3*a* there is a radial ring of guide vanes 5 with adjustable guide vanes 6; this radial ring of guide vanes 5 constitutes a variable turbine geometry.

Depending upon the mode of operation of the internal combustion engine the variable turbine geometry can be adjusted in its position by an associated actuation element, whereby the corresponding flow entry cross-section is varied. In the illustrated embodiment it is provided that in the combusting drive mode the guide vanes 6 of the radial ring of guide vanes 5 are adjusted for example in an open position, in order to allow the greatest possible mass flow through-put through the turbine 1 and to produce a high charger power. For achieving a motor brake power, in contrast, the radial ring of guide vanes 5 is moved into a blocking position with reduced cross-section by an appropriate adjustment of the guide vanes 6. On the basis of the reduced flow total cross-section, in comparison to the combustion operation mode, an elevated exhaust gas pressure builds up in the exhaust channel upstream of the turbine, simultaneously an over-pressurization is produced in the intake stroke. In the motor brake operation brake valves are opened in the cylinder outlet of the internal combustion engine, the air compressed in the cylinder must work against the elevated exhaust gas pressure in the exhaust pipe to be pushed out.

In the flow channel 3 of the turbine 1 a flow ring 7 is provided, which borders the radial flow entry profile or cross-section 3*a*. The flow ring 7 is axially displaceable in the exhaust gas turbocharger; the axial displaceability is indicated with the double arrow 8. On the radial inner lying side of the flow ring 7 a sealing ring 11 is seated in a groove of a housing component, which is associated with the bearing housing 12, to provide a seal. Preferably the seal ring is held against a heat shield 13, which is connected fixed with the bearing housing 12.

The housing-fixed heat shield 13 exhibits two steps on the side facing the flow ring 7, which form abutments for the axially displaceable flow ring 7, which exhibits a contour conforming to these steps. In FIG. 1 the flow ring 7 is shown in a position lying gap-free against radial ring of guide vanes 5; the axial displacement out of this position is limited by the abutments on the housing-fixed component 13, against which the flow ring 7 abuts. The sealing ring 11 prevents leakage bypass flows between the flow ring 7 and the radially inwardly lying, housing-fixed component 13, upon which the flow ring 7 is radially seated in the contact position.

In the position shown in FIG. 1 the flow ring 7 lies axially tight or sealingly against the face of the radial ring of guide vanes 5, no radial gap is formed, whereby radial leakage bypass is prevented. In the radial flow entry cross-section 3*a* spacer sleeves 14 can also be provided in addition to the radial ring of guide vanes 5, which limit the axial displaceability of the flow ring 7 in the direction of the radial ring of guide vanes 5.

The adjustable guide vanes 6 of the radial ring of guide vanes 5 are rotatably mounted in shafts 15*a* and 15*b*, wherein the two shafts 15*a* and 15*b* extend out from axially oppositely lying sides of the guide vanes and wherein the first shaft 15*a* is received in the housing and the second shaft 15*b* on the other hand is received in the displaceable flow ring 7. The second shaft 15*b* is received in a recess in the flow ring 7, wherein the depth of the recess corresponds at least to the shaft length, so that in the case of the axially contacting position of the flow ring 7 against the radial ring of guide vanes 5 a flush or gap-free axial lying-against is ensured.

The adjustable guide vanes 6 are bordered axially on both sides by cover discs 16 and 17, which are received in correspondingly shaped recesses in the receiving housing side component or, as the case may be, in the wall the flow ring 7 facing the guide vanes 6.

Figure 2:
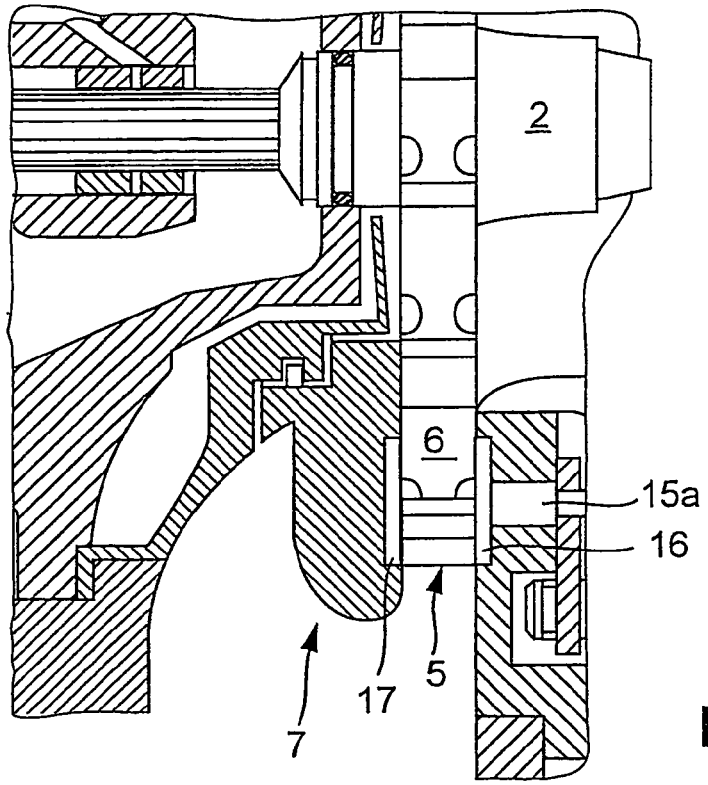

The illustrative embodiment shown in FIG. 2 corresponds essentially to that of FIG. 1, however with the difference that the adjustable guide vanes 6 of the radial ring of guide vanes 5 only exhibit a single shaft 15*a* on the housing side. This embodiment provides the advantage, that it becomes possible to dispense with the recesses in the flow ring 7 on the guide-vane 6 facing side for receiving the corresponding shaft pieces. Also in the embodiment in FIG. 2, two cover discs 16 and 17 are provided for the two axial sides of the guide vanes 6.

Figure 3:
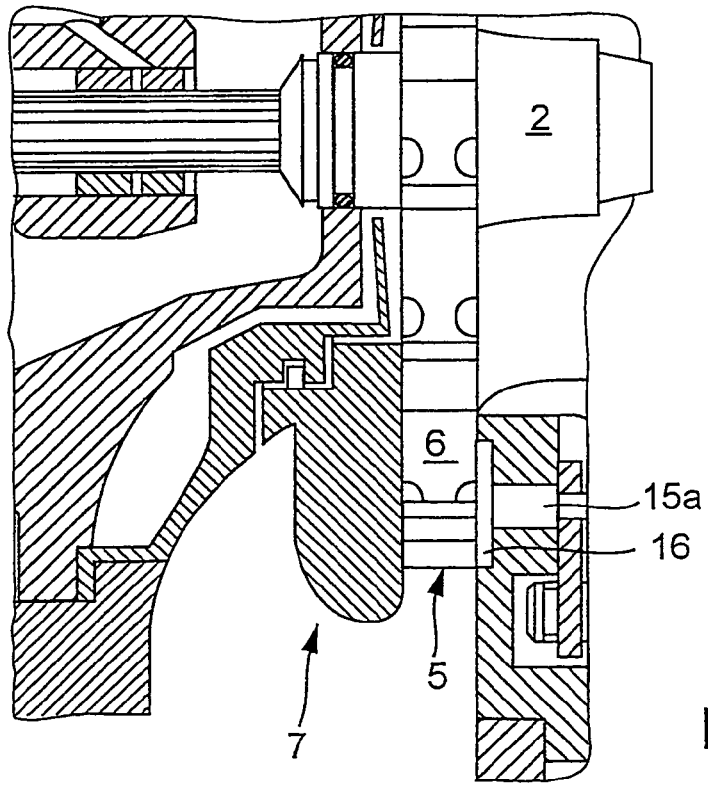

In the illustrative embodiment according to FIG. 3 the guide vane 6 of the radial ring of guide vanes 5 essentially exhibits one shaft 15*a* on the housing side and also only one cover disc 16 on the housing side.

Preferably the flow ring 7 and/or the radial ring of guide vanes 5 are designed in an aerodynamic manner or, as the case may be, constructed for flow efficiency, such that the flow ring 7 experiences, due to the inflow over the flow channel 3, a resulting pressure force in the axial direction of the turbine shaft. The resulting pressure force impinges upon the flow ring 7 preferably in the direction of the radial ring of guide vanes 5 in the radial flow entry cross-section 3*a*, so that the axial end face gap between the end face side of the radial ring of guide vanes 5 and the flow ring 7 is closed. The aerodynamic design of the radial ring of guide vanes 5 is preferably achieved by the design of the position of the guide vanes on the radial ring of guide vanes.

It could however also be advantageous that the flow ring is moved in the direction of an increasing axial gap, in order to prevent over-rotation.

The invention claimed is:

1. An exhaust gas turbocharger for an internal combustion engine, with a turbine adapted for receiving the engine exhaust gas flow, and with a turbine driven compressor for providing intake flow to the internal combustion engine, wherein the turbine (1) has a flow channel (3) with a radial flow entry section (3*a*) and a further flow entry section, wherein a flow ring (7) separates the flow entry cross-section (3*a*) and the further flow entry section and borders the flow entry cross-section (3*a*), wherein an adjustable ring of guide vanes (5) is provided in the radial flow entry cross-section (3*a*) for variably adjusting the flow entry cross-section (3*a*), wherein the flow ring (7) is axially displaceable in the housing of the exhaust gas turbine (1) between a position contacting the ring of guide vanes (5) and a position exposing a gap between the flow ring (7) and the ring of guide vanes (5), and wherein axial relief boreholes are provided in the flow ring (7) extending between the axial faces of the flow ring for trimming of forces acting on the flow ring (7) when lying against the radial ring of guide vanes (5) in such a manner, that as a result of the reduction in static pressure in the ring of guide vanes (5) the flow ring (7) experiences a resulting pressure in the direction of the radial ring of guide vanes (5).

2. The exhaust gas turbocharger according to claim 1, wherein abutments or end stops (18, 19) are provided fixed relative to the housing for limiting the axial displaceability of the flow ring (7).

3. The exhaust gas turbocharger according to claim 1, wherein spacer sleeves (14) are provided in the radial flow cross-section (3*a*), which determine the minimum axial breadth of the radial flow entry cross-section (3*a*).

4. The exhaust gas turbocharger according to claim 1, wherein a seal ring (11) is provided on the radial inner-lying side of the flow ring (7) for sealing against a housing fixed component (13).

5. The exhaust gas turbocharger according to claim 1, wherein the radial ring of guide vanes (5) includes adjustable guide vanes (6), which include cover discs (16, 17) on at least one axial end face.

6. The exhaust gas turbocharger according to claim 1, wherein adjustable guide vanes (6) of the radial ring of guide vanes (5) are mounted in the turbocharger housing via an axial shaft (15*a*).

7. The exhaust gas turbocharger according to claim 1, wherein adjustable guide vanes (6) of the radial ring of guide vanes (5) are mounted in the flow ring (7) via an axial shaft (15*b*).

* * * * *